US005418543A

United States Patent [19]

Bolton

[11] Patent Number: 5,418,543

[45] Date of Patent: May 23, 1995

[54] ANTENNA FOR VEHICLE WINDOW

[75] Inventor: Christopher I. Bolton, Warrington, United Kingdom

[73] Assignee: Pilkington plc, England

[21] Appl. No.: 299,668

[22] Filed: Sep. 2, 1994

Related U.S. Application Data

[63] Continuation of Ser. No. 53,548, Apr. 29, 1993, abandoned.

[30] Foreign Application Priority Data

Apr. 30, 1992 [GB] United Kingdom ..... 9209332

[51] Int. Cl.[6] ..... H01Q 1/32; H01Q 9/38

[52] U.S. Cl. ..... 343/713; 343/846

[58] Field of Search ..... 343/713, 829, 830, 831, 343/826, 846, 847, 848; H01Q 1/32, 1/38, 9/38

[56] References Cited

U.S. PATENT DOCUMENTS 4,727,377 2/1988 Yotsuya et al. ..... 343/713

FOREIGN PATENT DOCUMENTS 0353378 2/1990 European Pat. Off. .
0500380 8/1992 European Pat. Off. .
3-265202 11/1991 Japan ..... H01Q 1/32
3-283801 12/1991 Japan ..... H01Q 1/32
4-314202 11/1992 Japan ..... H01Q 1/32
2235094 2/1991 United Kingdom .

*Primary Examiner*—Donald Hajec
*Assistant Examiner*—Hoanganh Le
*Attorney, Agent, or Firm*—Howrey & Simon

[57] ABSTRACT

An antenna design for use with mobile telephones improves antenna performance by:

(i) making the antenna less sensitive to the effects of the car body when mounted on a car window, e.g. backlight or sixthlight, and (ii) improving the impedance matching between the antenna and the coaxial feed line. Principally two arms extend from a ground plane strip around a separate monopole radiating "T"-piece. The ground plane and "T"-piece are insulated from each other and a coaxial connection is made to the antenna with the central core connected to the "T"-piece and the shield to the ground plane.

13 Claims, 3 Drawing Sheets

ANTENNA FOR VEHICLE WINDOW

This application is a continuation, of the application Ser. No. 08/053,548, filed Apr. 29, 1993, now abandoned.

The invention relates to an antenna formed on a vehicle window for transmission and/or reception of radio waves particularly but not exclusively for a mobile telephone.

BACKGROUND OF THE INVENTION

It is known to print antennae of various forms onto vehicle windows as they have advantages in not being exposed to external damage.

Such antennae can be used for mobile telephones in vehicles and it is an object of the present invention to provide an improved antenna on a vehicle window suitable for use with such a mobile vehicle telephone.

A conventional rod aerial externally mounted on a vehicle has two terminals normally connected to a coaxial cable the outer conductor of which provides an earth connection coupled to the vehicle body where the antenna is mounted. Other proposals have been made for incorporated such an antenna formed by conducting strips in the plane of a vehicle window.

It is an object of the present invention to provide an improved antenna on a vehicle window.

SUMMARY OF THE INVENTION

The present invention provides a vehicle window comprising a sheet for mounting on a vehicle body, said sheet supporting thereon adjacent an edge of the sheet an antenna system for transmission and/or reception of radio waves, said antenna system comprising (a) a first elongated conducting member forming a ground conductor and having a connection terminal, and (b) a second conducting member electrically insulated from the first conducting member and having a respective connection terminal, said first conducting member being located between the second conducting member and an edge of the sheet and having at least one conducting arm connected to the elongated conducting member and extending at least partially around but spaced from said second conducting member, both said conducting members and conducting arm lying in the plane of said sheet.

Preferably two conducting arms are connected to said first conducting member each of said arms extending part way around the second conducting member and spaced therefrom.

Preferably said two conducting arms are arranged symmetrically on opposite sides of said second conducting member so as to partially surround the second conducting member with a gap between them on a side of the second conducting member remote from said first conducting member.

Preferably said second conducting member is T-shaped.

Preferably the T-shaped second conducting member has a foot of the T nearest said first conducting member and said connection terminal for the second conducting member is adjacent the foot of the T.

Preferably said first conducting member is arranged to form a transmission line with said vehicle body when in situ and thereby form an earth line for the antenna system.

Preferably said first conducting member comprises a linear conductor extending substantially parallel to said edge of the sheet.

The invention includes a vehicle window as aforesaid in which a 50 ohm coaxial cable is connected to respective connection terminals of the antenna system.

In an embodiment the or each arm connected to said first elongated conducting member has a length substantially equal to $\frac{3}{4}$ of the wavelength in glass of the radio frequency for transmission or reception by the antenna.

BRIEF DESCRIPTION OF THE DRAWINGS

FIGS. *2a*, *2b* and *2c* show similar diagrams indicating the comparative vertical polarization achieved with the antenna of FIG. 1 in relation to that of a conventional mounted rod aerial at three different frequencies covering the range normally used by a mobile telephone.

DESCRIPTION OF THE PREFERRED EMBODIMENTS

Figure 1:
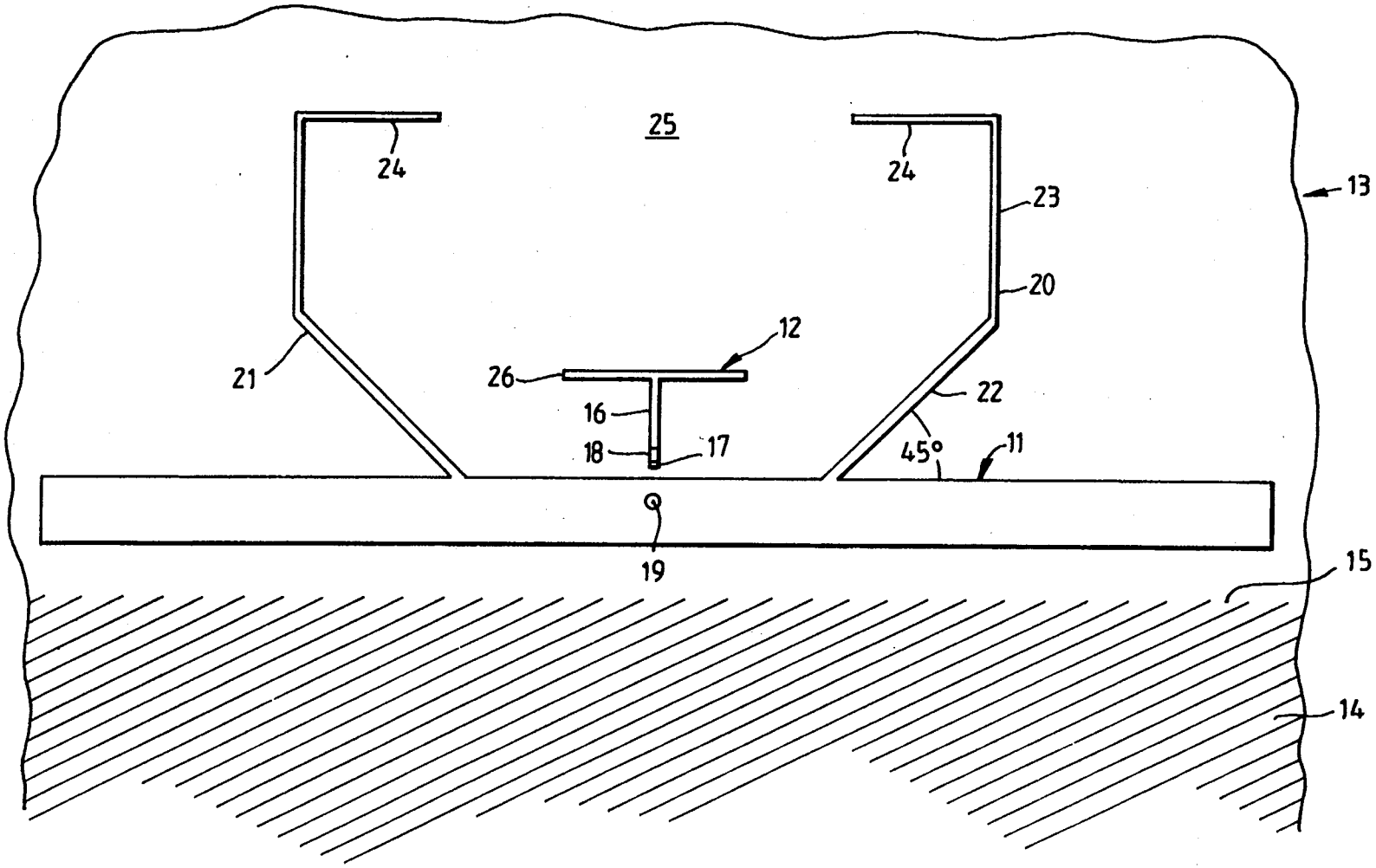
FIG. 1 shows part of a vehicle window mounted on a car body and including an antenna in accordance with the present invention.
Figure 2A:
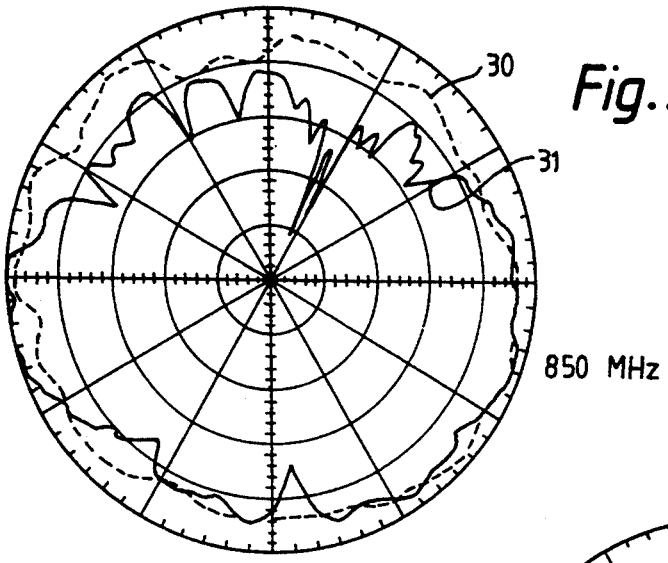
Figure 2B:
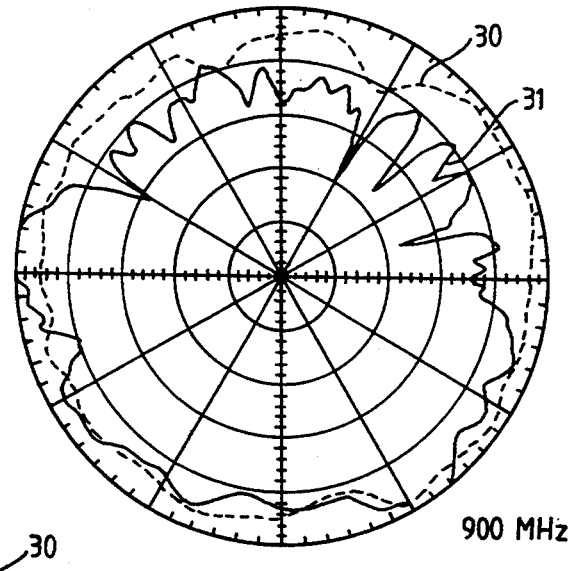
Figure 2C:
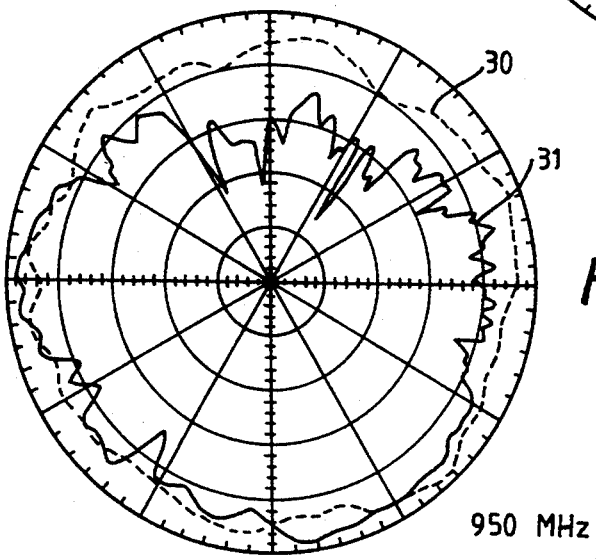

The example of FIG. 1 provides an antenna suitable for use with a cellular radio phone, the antenna comprising first and second conducting members 11 and 12 supported on a transparent glass sheet 13 mounted on a vehicle body 14. The antenna may be printed or otherwise formed on the glass sheet so that the conducting members 11 and 12 lie effectively in the plane of the sheet which may be flat or curved. The conducting members may be applied to an inner surface of glass in a laminate window or alternatively and more usually they may be formed on an external glass surface of a laminate or a monolith sheet. They may also be covered by an electrically insulating sheet such as a plastics film which may be transparent or opaque. Alternatively a non-conductive substance may be printed or painted over otherwise accessible parts of the conducting members.

The first conducting member 11 comprises a straight elongated conducting strip extending parallel to but spaced from an edge 15 of the window aperture in the car body 14. Centrally located along the strip 11 is the second conducting member 12 which in this example is a T-shaped member having a stem 16 extending perpendicular to the length of the strip 11. A foot 17 of the T 12 is located nearest but spaced from the strip 11 by a distance between 1 mm to 5 mm and includes a connection terminal 18 adjacent the foot. The strip 11 has a respective connection terminal 19 at its mid position. In use terminal 19 is connected to the external conductor of 50 ohm coaxial cable and terminal 18 is connected to the internal conductor of the coaxial cable. This example provides improved matching of the antenna impedance with the coaxial cable impedance over a broad band width. Conductor 11 is spaced only a short distance from the edge 15 of the car body and acts as an electrical transmission line between itself and the adjacent metal body work of the vehicle. In this way the transmission line formed by the conductor 11 acts as an open circuit at its outer ends and thereby forms an effective short circuit between the conductor 11 and the adjacent vehicle body work 14. This has the same effect as connecting the outer braid of the coaxial cable to the body work 14 and thereby provides an earth.

In this particular example, the first conductor 11 is provided with two conducting arms 20 and 21 each connected to the conductor 11 and arranged symmetrically on opposite sides of the second conductor 12 so as to extend partially around but spaced from the conductor 12. Each of the conducting arms 20 and 21 is similar in shape and comprises a first straight element 22 extending outwardly towards the end of the conductor 11 at an angle of 45° to the conductor 11. A second section 23 extends perpendicular to the conductor 11 and a third and final section 24 extends back towards the T-shaped conductor 12 in a direction parallel to the conducting strip 11. The ends of the respective portions 24 are spaced apart to form a gap 25 on the side of the T-shaped conductor 12 opposite the elongated conductor 11. The gap 25 is symmetrically located relative to the T-shaped conductor 12 and is wider than the width of the head 26 of the T-shaped conductor 12. In this way the arms 20 and 21 partially surround the conductor 12 by elements which extend in more than one direction both away from conductor 11 and along conductor 11.

In this particular example the section 22 of the conducting arms 20 and 21 are inclined at 45° to the length of the conductor 11. The conductor 11 has a length of 250 mm and a gap of between 5 and 20 mm is provided between the conductor 11 and the edge 15 of the car body. The T-shaped conductor 12 has a width across the head 26 of 40 mm and the head 26 is spaced 20 mm from the closest edge of the elongated conductor 11. Each of the arms 20 and 21 has an overall length between 160 to 170 mm which corresponds to $\frac{3}{4}$ of the wavelength in glass of the cellular frequencies used for the radio of this example.

FIGS. *2a, 2b* and *2c* show the vertical polarization results of use of the above described antenna for frequencies of 850 MHz, 900 MHz and 950 MHz respectively which covers the usual frequency range of a mobile telephone.

The results shown in these diagrams show the comparative results for the preferred example described above in relation to equivalent results from a conventional centre mounted rod on the exterior of a vehicle. In each of the diagrams the broken line 30 represents the results achieved for the conventional centre mounted rod whereas the continuous line 31 represents the results achieved with the antenna of the present embodiment.

It will be seen that over the range of frequencies used in obtaining these three different results, the performance of the antenna of this example is a close approximation to that obtained with a conventional externally mounted rod aerial.

Figure 3:
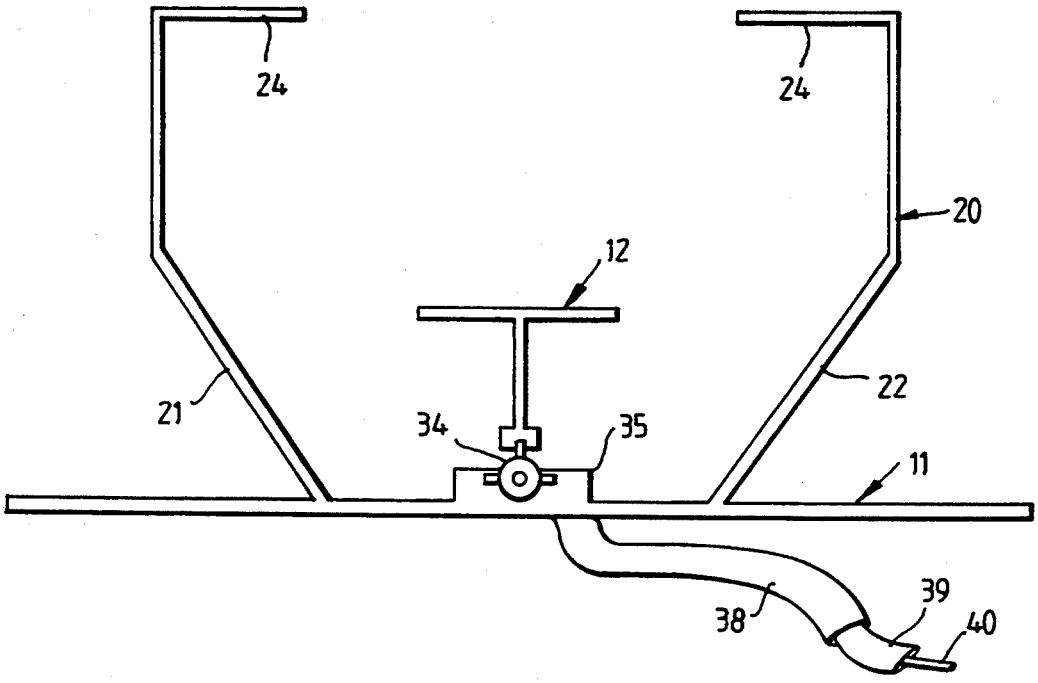
FIG. 3 shows a modification of the arrangement shown in FIG. 1.
Figure 4:
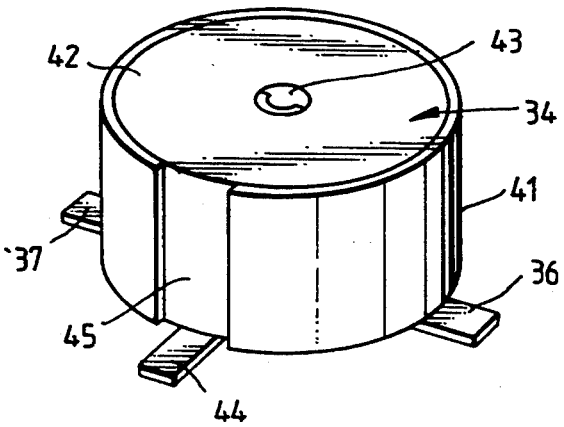
FIG. 4 shows a connector used in FIG. 3.

The alternative embodiment shown in FIGS. 3 and 4 has first and second conducting members 11 and 12 generally as previously described with reference to FIG. 1. In this example the central region of the first conducting member 11 is formed with an enlarged conducting region 35 which makes electrical contact with two conducting lugs 36 and 37 on opposite sides of a standard female connector 34 for a coaxial cable 38. The coaxial cable 38 has an earth braid 39 and central wire 40 as illustrated in FIG. 3. The connector 34 comprises a cylindrical conducting sleeve 41 connected to the lugs 36 and 37. The central part 42 is formed of insulating material surrounding a central bore 43 which is in the form of a conducting sleeve connected to a conducting tag 44 adjacent a break 45 in the outer conducting sleeve 41. As shown in FIG. 3 the connector 34 is mounted so that the conducting lug 44 engages the lower end of the T-shaped conductor 12. The two side lugs 36 and 37 engage the enlarged conductor 35 of the conducting strip 11. When connected to a coaxial cable as shown in FIG. 3, the cable 38 is connected to a standard coaxial male connector which engages the female connector shown in FIG. 4 so that the central wire 40 of the cable 38 is connected to the T-shaped conductor 12 and the outer earthing braid 39 is connected to the elongated conducting strip 11. In this way the T-shaped conductor 12 acts as a radiating conductor for the signal and the elongated strip 11 acts as a ground conductor.

The preferred embodiments described have a performance which is less sensitive to variations in the aperture of the car body to which the window is fitted. It may be used in a variety of different sized apertures such as a back light or a sixth light at the rear side of a vehicle. It also provides improved impedance matching with the co-axial cable.

The invention is not limited to the details of the foregoing examples.

I claim:

1. A vehicle window comprising a sheet for mounting on a vehicle body, said sheet supporting thereon adjacent an edge of the sheet an antenna system for transmission and/or reception of radio waves, said antenna system comprising:

(a) a first conducting member forming a ground conductor and having a connection terminal, and (b) a second conducting member electrically insulated from the first conducting member and having a respective connection terminal, said first conducting member having (1) an elongated conductor located between the second conducting member and an edge of the sheet and (2) at least one conducting arm connected to the elongated conductor and extending at least partially around but spaced from said second conducting member to extend along a side of the second conducting member opposite from the elongated conductor; both said conducting members lying in the plane of said sheet.

2. A vehicle window according to claim 1 in which two conducting arms are connected to said elongated conductor each of said arms extending part way around the second conducting member and spaced therefrom.

3. A vehicle window according to claim 2 in which said two conducting arms are arranged symmetrically on opposite sides of said second conducting member so as to partially surround the second conducting member with a gap between them on a side of the second conducting member remote from said elongated conductor.

4. A vehicle window according to claim 1 in which said second conducting member is T-shaped.

5. A vehicle window according to claim 4 in which the T-shaped second conducting member has a foot of the T nearest said elongated conductor and said connection terminal for the second conducting member is adjacent the foot of the T.

6. A vehicle window according to claim 4 in which the antenna system is arranged to transmit and/or receive radio waves in the range 850 to 980 MHz.

7. A vehicle window according to claim 1 in which said first conducting member is arranged to form a transmission line with said vehicle body when in situ and thereby form an earth line for the antenna system.

8. A vehicle window according to claim 7 in which said elongated conductor comprises a linear conductor extending substantially parallel to said edge of the sheet.

9. A vehicle window according to claim 1 in which said second conducting member includes an element extending perpendicular to said elongated conductor said element being situated substantially centrally along said elongated conductor.

10. A vehicle window according to claim 1 in which said first conducting member is connected to an earth conductor of a coaxial cable.

11. A vehicle window according to claim 10 in which a 50 ohm coaxial cable is connected to respective connection terminals of the antenna system.

12. A vehicle window according to claim 1 in which said antenna system is formed on a transparent sheet below a transparent insulating layer.

13. A vehicle window according to claim 1 in which the or each arm connected to said elongated conductor has a length substantially equal to $\frac{3}{4}$ of the wavelength in glass of the radio frequency for transmission or reception by the antenna.

* * * * *